US005524678A

United States Patent [19]

Haeussler et al.

[11] Patent Number: 5,524,678

[45] Date of Patent: Jun. 11, 1996

[54] LENO SELVAGE DEVICE FOR A LOOM WITH A LENO ROTOR DRIVEN BY ITS OWN MOTOR

[75] Inventors: Horst Haeussler; Hans-Joachim Holz, both of Lindau; Valentin Krumm, Hergensweiler, all of Germany

[73] Assignee: Lindauer Dornier Gesellschaft mbH, Lindau, Germany

[21] Appl. No.: 391,551

[22] Filed: Feb. 21, 1995

[30] Foreign Application Priority Data

Feb. 23, 1994 [DE] Germany ..... 44 05 777.6
Feb. 23, 1994 [DE] Germany ..... 44 05 778.4

[51] Int. Cl.[6] ..... D03C 7/08; D03C 7/04

[52] U.S. Cl. ..... 139/54; 139/50; 139/55.1

[58] Field of Search ..... 139/54, 55.1, 50

[56] References Cited

U.S. PATENT DOCUMENTS

| | | | |
|---|---|---|---|
| 3,880,199 | 4/1975 | Riha et al. | 139/54 |
| 3,945,406 | 3/1976 | Wueger | 139/54 |
| 3,998,247 | 12/1976 | Kovar | 139/54 |
| 4,353,396 | 10/1982 | Suzuki et al. . | |
| 4,412,562 | 11/1983 | Kobayashi et al. . | |

FOREIGN PATENT DOCUMENTS

| | | |
|---|---|---|
| 229700 | 1/1911 | Germany . |
| 1237509 | 3/1967 | Germany . |
| 2423454 | 4/1975 | Germany . |
| 2515961 | 1/1976 | Germany . |
| 2832131 | 1/1980 | Germany . |
| 069627 | 4/1989 | Japan . |
| WO94/29502 | 12/1994 | WIPO . |

*Primary Examiner* Andy Falik
*Attorney, Agent, or Firm* W. G. Fasse; W. F. Fasse

[57] ABSTRACT

A leno selvage device for a loom has a leno rotor ring (7) which is directly driven by its own reversible electric motor, for example, through a power transmission such as a gear belt (6) running around a drive gear pulley (5). The controllable electric motor (20) is operated through a respective program for either oscillating the leno rotor back and forth, e.g. through 180° or for revolving the leno rotor for a number of revolutions in one direction and then for the same number of revolutions in the opposite direction and so forth. The arrangement is such that the central rotational axis (5A) of the drive pulley (5) and the central rotational axis (7A) of the leno rotor ring (7) are positioned in different geometrical planes relative to a carrier arm (2), but in parallel to each other and to the weft insertion direction. The carrier arm (2) provides a plurality of bearing rollers which support the leno rotor ring or disk (7) at the outer circumference thereof by at least two, preferably three guide rollers.

14 Claims, 5 Drawing Sheets

LENO SELVAGE DEVICE FOR A LOOM WITH A LENO ROTOR DRIVEN BY ITS OWN MOTOR

CROSS-REFERENCE TO RELATED APPLICATION

The present application relates to our copending, commonly assigned application U.S. patent application Ser. No. 08/391,970, filed simultaneously with this application. Our Docket No. 3139, Title: Leno Selvage Device Having a Leno Rotor Forming the Rotor of an Electric Motor.

FIELD OF THE INVENTION

The invention relates to a leno selvage device for a loom. Such a device forms a leno binding with the aid of leno threads that bind the weft threads along the selvage of both fabric edges.

BACKGROUND INFORMATION

German Patent Publication DE 2,423,454 C2 (Riha et al.), published on Apr. 3, 1975, discloses a leno selvage device for reinforcing the selvage by a so-called leno binding or leno weave. The known apparatus comprises a power driven leno disk having a rotational central geometric axis extending in parallel to the weft thread insertion direction in the loom. The leno disk is driven with the same r.p.m. as the r.p.m. of a carrier carrying leno thread supply spools. The leno disk has two eyelets arranged symmetrically relative to the central rotational axis of the disk.

The known leno device has two sections. One section is positioned on each side of the loom next to the respective warp threads. Both leno sections are driven through a coupling such as a gear belt connected to a drive wheel for a positive drive. The drive wheel is connected rigidly to a reduction gear shaft which in turn is driven by a reduction gear. The reduction gear with its shaft is coupled in a drive power transmitting manner with the main drive shaft of the loom.

For adapting the leno device of German Patent Publication DE 2,423,454 C2 to different weaving widths, the reduction gear shaft is coupled to a hollow shaft extending in the direction of the weaving width adjustment, namely in the direction of the weft insertion. A shaft section that drives the second leno device and the second leno spool holder is axially displaceable relative to the hollow shaft.

Deriving the drive power for both leno sections from the main loom drive requires a substantial number of drive components and hence is expensive. These drive components also require a substantial space in the loom and it is not possible to control the two leno sections independently of the main loom drive nor independently of each other.

German Patent Publication (DE-OS) 2,832,131 (Shindo et al.) published on Jan. 31, 1980, discloses a leno device for forming a leno selvage in a shuttleless loom, wherein the leno disk is part of a so-called satellite leno device. The leno disk has outer gear teeth meshing with other gears of the satellite leno device. The leno disk is rotatably mounted on a steady rest type carrier arm. The leno threads are pulled off from a spool rotor which is rotationally coupled to the leno disk. The leno threads pass through a substantially centrally located guide opening in the leno disk which additionally comprises two thread eyes positioned diametrically opposite each other in the leno disk. The threads pass through these thread eyes to the tie-up point along the selvage of the fabric.

The outer gear teeth of the leno disk mesh with the gear teeth of a drive gear wheel which drives the leno disk and the respective leno spool holder in synchronism with each other. German Patent Publication (DE-OS) 2,832,131 shows a drive shaft 44 for the satellite leno device and it is assumed that the drive power for the shaft 44 is derived from the main loom drive as is customary. As a result, the same drawbacks apply as have been mentioned above. Further, such conventional leno drives are not easily adapted to different weaving widths as is especially shown by German Patent Publication DE 2,423,454 C2 first mentioned above.

Conventionally, a relatively large space is required for the leno devices on the right-hand side and on the left-hand side of the loom shed formed by the warp threads. The conventional leno devices are arranged in the area of the rear shed which means that the number of heald shafts is limited by the position of the leno devices. Further, the length of the leno threads measured from the leno device to the tie-up point of the weft thread is relatively large. As a result, the leno shed formed by the leno threads is relatively flat or rather the angle enclosed by the two leno threads is relatively acute, which has the drawback that it is not assured that each weft thread end is properly inserted into the leno shed.

Conventionally it is necessary to rotate the leno thread spool carriers to avoid twisting of the leno threads in the area of the rear shed. The twisting must be avoided because it can break the leno threads. The rotation of the leno thread spool carriers makes sure that untwisted leno threads are presented to the leno disk.

OBJECTS OF THE INVENTION

In view of the above it is the aim of the invention to achieve the following objects singly or in combination:

to avoid the drawbacks of the prior art and to make sure that each weft thread end is properly inserted into the leno shed at each selvage;

to construct the leno sections so that each leno section is individually drivable and controllable whereby the operation of the leno sections and their construction are independent of the main loom drive;

to make sure that each end of the weft thread is properly tied-up in the leno selvage to obtain a high quality and durable leno selvage;

to construct a leno selvage device in such a way that upon changing to another fabric it is not necessary to separate the leno selvage device from the loom, whereby the present selvage device shall be easily adaptable to different weaving widths to thereby substantially reduce the set up time of the loom;

to avoid a separate drive for the leno thread spool carriers while still preventing twisting of the leno threads;

to use, compared to the relatively small leno thread capacity of conventional leno supply spools in a so-called satellite leno system, large capacity leno thread supply spools of the so-called "king spool" type to assure long weaving times as compared to the relatively short weaving times in satellite leno spool systems; and to provide a compact construction of the leno device in such manner that the leno spools of substantial capacity may even be mounted within the space available in a ring type leno rotor.

SUMMARY OF THE INVENTION

The present leno selvage device comprises a leno rotor through which two leno threads pass for opening and closing a leno shed under the control of a reversible electrical motor which itself is program controlled and which drives the leno rotor either directly or preferably through a slip-free drive transmission between the motor output shaft and the leno rotor which is preferably a ring or wheel or disk. The device with its motor forms a structural unit that can be mounted in the most convenient position in the loom without regard to deriving any drive power from the main loom drive since the control and drive power for the leno drive motor is electrical.

The present electric motor drive for a leno rotor disk or ring now makes it possible to control the motion sequence of the individual leno devices independently of one another and independently of the main loom drive. This feature has the advantage that it is now possible to control the drive of the leno rotor, for example, with reference to the type of weft thread being used in the particular fabric so that the tie-up for the weft threads is individualized and so that the tie-up of the weft thread end at the entrance side of the loom shed may take place prior to the tie-up of the weft thread end at the exit side of the loom shed.

According to the invention it is now further possible, due to the individual control of the leno disks to form selvage borders and weft compactions with different tie-ups without additional structural effort and expense. For example, it is now possible to form single weft tie-ups and to avoid tie-ups simply by a respective control of the drive of the corresponding leno rotor, whereby even multi-weft tie-ups are possible.

Another advantage of the invention is seen in that a controlled reversal of the rotational direction of the leno rotor, for example, by an oscillating reversal of the leno rotational direction or by an equal number of rotor revolutions in one direction and then in the opposite direction, it is now possible to avoid the rotational drive of the leno thread supply spool carrier altogether. The oscillatory motion of the leno rotor or the alternating revolutions first in one direction and then in the opposite direction compensates for any twisting of the leno threads on their way from the leno supply spools to the leno rotor by a respective untwisting when the leno rotor revolves in the opposite direction. For example, any twisting caused by a certain number of clockwise revolution of the leno rotor are untwisted again by a corresponding number of counterclockwise revolutions of the leno rotor.

Furthermore, it is now possible with the present motor driven leno rotor to perform, without any difficulties, within the loom control, an r.p.m. adjustment between the motion of the shed forming components of the loom and the r.p.m. or oscillation of the leno rotor. The adjustment is performed in such a way that the motion sequence of the shed forming components is substantially congruent to the motion sequence of the leno selvage device that defines or forms the geometry of the leno shed. This feature makes sure that the weft threads are positively and consistently inserted into the respective left-hand and right-hand leno shed.

Still another advantage of the invention is seen in the fact that the present leno selvage device, due to its independence of the main loom drive, can be housed in an individual housing that can be substantially sealed and positioned within the loom in the most convenient place independent of drive considerations. The enclosed housing also protects the leno selvage device against contaminations, for example, by lint such as flying lint. Advantageously, the present leno device is positioned as close as possible to the tie-up point in the selvage of the fabric, between the heald frame and the heddles of the first heald shafts just upstream of the reed as viewed in the advance direction of the fabric. This position of the present leno device assures a minimum spacing between the rotational axis of the leno rotor and the respective tie-up point which has the advantage that the present device does not limit the number of heald shafts that may be positioned in the direction toward the warp beam.

The present leno device is compact, which facilitates the rapid positioning and adjusting of the device in accordance with changing conditions that must be met by the loom when, for example, the type of weave is changed or when the weaving width is to be adjusted.

The position of the present leno device just upstream of the reed as compared to the satellite leno device that is positioned just downstream of the warp beam, has yet another advantage in that the leno stroke to be performed by the leno threads in the present device is only about 80 mm as compared to a stroke of about 180 mm in a conventional satellite leno device. Yet, surprisingly, the substantially smaller stroke according to the invention assures a satisfactory opening of the leno shed for the proper insertion of the weft ends. The leno stroke is the maximum spacing between the two leno threads as caused by the revolution or oscillation of the leno rotor.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
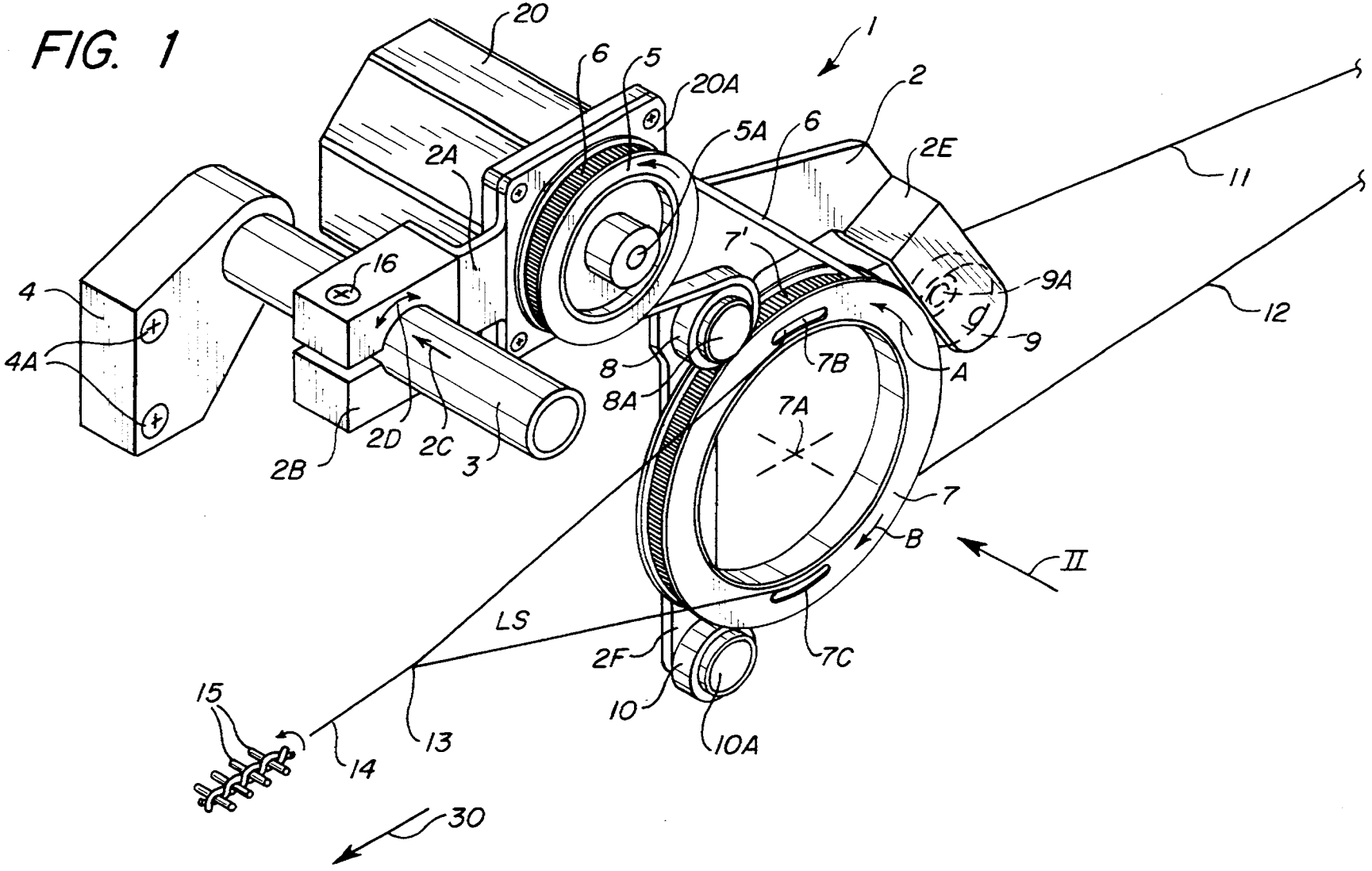
FIG. 1 is a schematic perspective view of a leno selvage device according to the invention.

FIG. 1 shows a leno selvage device 1 according to the invention comprising a carrier arm 2 constructed as a steady rest for rotatably supporting a leno rotor 7. The leno rotor 7 is preferably a disk and more preferably a rotor ring that provides a lightweight construction. The carrier arm 2 has a bracket section 2A connected to a mounting clamp 2B which is secured to a mounting stub 3 that in turn is connected to a mounting bracket 4 secured by screws 4A to a loom frame not shown. The mounting clamp 2B and with it the leno device can be loosened by loosening a screw 16, whereby the clamp 2B and with it the leno device can be adjusted axially as indicated by the double arrow 2C along the mounting stub 3 for adjusting the leno device for different weaving widths. When the clamp 2B loosened, by loosening the screw 16 it can also be adjusted angularly as indicated by the arrow 2D which also facilitates the proper positioning of the present leno device 1.

The arm 2 forms a shield 20A which in turn is connected to the bracket 2A. The shield 20A carries on its backside an individually controllable electrical drive motor 20 having a drive shaft 5A carrying a drive wheel 5, for example, a gear pulley. The pulley 5 drives a drive belt 6 such as a gear belt which provides a slip-free drive of the leno rotor 7. The gear belt 6 forms a looping angle around the pulley 5. The looping angle is determined by the position of an axle 8A rotatably carrying a guide roller 8. The axle 8A is rigidly secured to the arm 2. The arm 2 has an elbow 2E carrying an axle 9A with a further guide roller 9 for guiding the leno rotor ring 7. The arm 2 further has an extension 2F carrying an axle 10A which in turn carries a guide roller 10 to form a third rotatable support for the leno rotor ring 7. As mentioned, the carrier arm 2 with its extensions 2E and 2F and with the guide rollers 8, 9, and 10 forms a steady rest for the leno rotor ring 7, the outer circumference of which is provided with gear teeth 7' that mesh with the gear belt 6, for example. Additionally, the leno rotor ring 7 is provided with two arcuate slots or thread eyelets 7B and 7C arranged diametrically opposite each other and passing through the ring 7 in an axial direction. The ring 7 has a rotational axis 7A extending in parallel to the rotational axis 5A of the motor 20 and in parallel to the longitudinal axis of the stub 3. These components all extend in parallel to the weft insertion direction. The angular spacing between the axles 8A, 9A and 10A is so selected that a secure three-point support in the manner of a steady rest is provided for the ring 7. The rollers 8, 9, and 10 contact the drive belt 6 on the bolt side opposite the belt side that engages the ring 7, whereby the latter is maintained in a properly centered position. However, the guide roller 10 and thus the extension arm 2F and the axle 10A could be omitted if under certain conditions it is sufficient that the ring 7 is guided by the belt 6 and only two rollers 8 and 9.

The leno thread guide slots 7B and 7c have a curved configuration that conforms to the circular shape of the ring 7. A first lane thread 11 passes through the slot 7B. A second leno thread 12 passes through the slot 7C. These lane threads 11 and 12 are pulled off two supply rollers 21 and 22 shown in FIG. 3. The mounting for these supply rollers is stationary according to the invention. The threads 11 and 12 form a front leno shed LS upstream of the tie-up point 13 as viewed in the fabric travel direction 30. The selvage is formed by the tie-up of the ends of the weft threads 15 in the fabric 14 which travels in the direction of the arrow 30 in FIG. 1. The second leno device according to the invention is constructed mirror-symmetrically to the device shown in FIG. 1 and is arranged at the opposite side of the loom so that both ends of each of the weft threads 15 are tied-up. Preferably, the trailing end at the insertion side of the weft thread is tied-up prior to tying-up the leading end of the weft thread at the exit end of the weft thread insertion channel so that a strong selvage is formed along both edges of the fabric 14. FIG. 1 shows a left-hand selvage device as viewed opposite to the fabric travel direction 30. Thus, the device shown is positioned at the weft entrance end. A mirror-symmetrical second device will be arranged at the exit end or right-hand side of the loom as viewed by an operator facing the loom. Both leno selvage devices according to the invention are arranged in the area of the heald frame and the heddles of the first heald shaft just upstream of the reed 18 as viewed in the fabric travel direction 30 and as shown in FIG. 2 by dashed lines.

Figure 2:
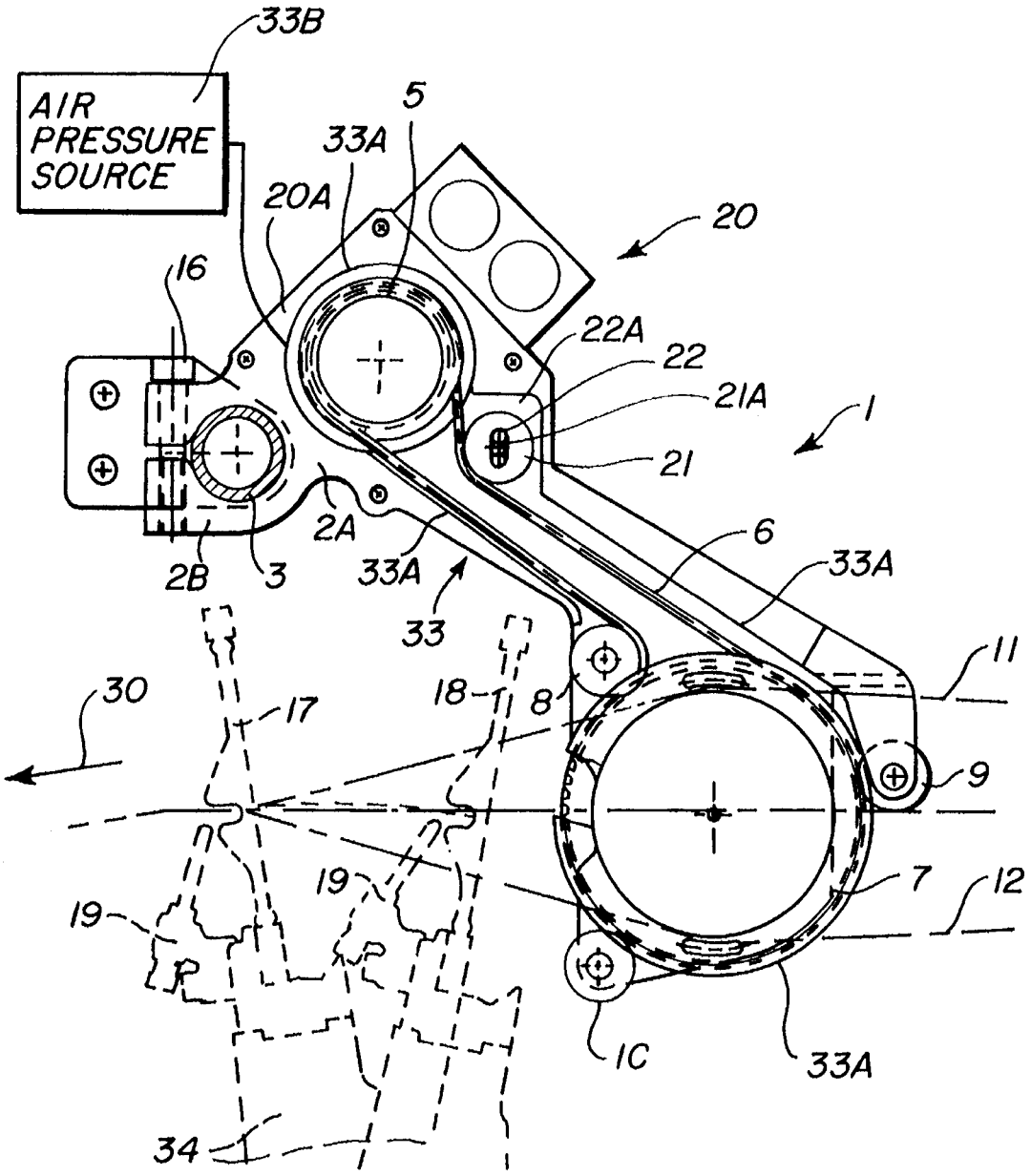
FIG. 2 is a view approximately in the direction of the arrow II in FIG. 1, but showing a modified leno device installed in a substantially closed housing.

FIG. 2 also illustrates a left-hand leno selvage device according to the invention, whereby the same components are provided with the same reference numbers as in FIG. 1. However, in FIG. 2 a modified carrier arm 33 is employed. The modification in the construction of the carrier arm 33 provides a support and a housing for the present leno device, especially for the leno rotor and the drive transmission 5, 6 between the motor output drive shaft 5A and the leno rotor. Thus, the carrier arm 33 has housing walls 33A that extend perpendicularly to the plane of the drawing toward the viewer to form the housing which is adapted to be closed by a cover except for cut-outs to permit the guide rollers 8, 9, and 10 to contact the gear belt 6 and thus to rotatably support the leno rotor ring 7. Preferably, a slight excess pressure is maintained by a pressure source 33B in the housing 33A to keep out dust, lint, and the like. The housing is preferably a precision cast component.

The dashed lines in FIG. 2 illustrate, on a reduced scale, a reed in a beat-up position 17 and in a returned or back position 18. An auxiliary nozzle 19 is connected to the slay 34. The electric motor 20 which is individually controllable, is mounted to the shield 20A to drive the pulley 5 as described above with reference to FIG. 1.

FIG. 2 further shows a belt tightening roller 21 mounted for rotation on an axle stub 21A which in turn is adjustably mounted in an elongated slot 22 in a wall portion 22A of the carrier arm 33. By loosening the mounting of the axle stub 21A, the roller 21 can be repositioned to thereby tighten or loosen the belt 6. After the proper position of the roller 21 is established, the mounting of the axle stub 21A is tightened again.

Figure 3:
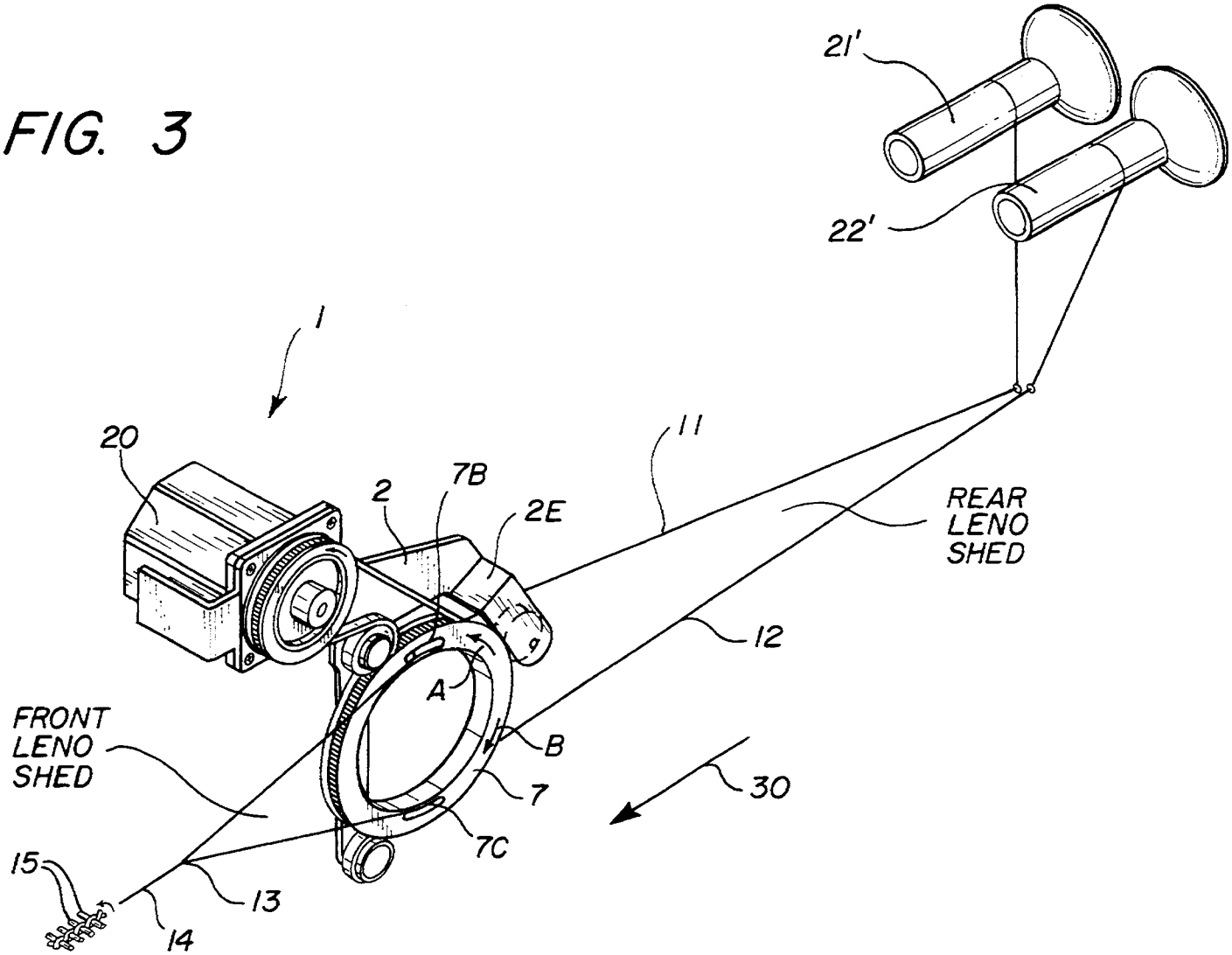
FIG. 3 is a perspective view similar to that of FIG. 1, however showing the formation of the front leno shed, the rear leno shed, and the position of the leno thread supply spools, the carrier of which is not rotated according to the invention.

The use of an electrically controllable drive motor 20 for driving the leno rotor ring 7 avoids the need for a separate rotary drive for the leno thread supply spools 21' and 22' shown in FIG. 3 because, according to the invention, twisting of the leno threads 11, 12 is avoided by programming the control of the motor 20. More specifically, by rotating the drive shaft 5A of the motor 20 and thus the leno rotor ring 7 for a number of revolutions in one direction and then for the same number of revolutions in the opposite direction avoids the twisting problem.

The control of the electric drive motor 20 according to the invention makes it further possible to alternatingly reverse the rotational direction of the leno rotor ring 7 as shown by the arrows A and B in FIG. 1, whereby the ring 7 oscillates back and forth, for example through 180° in accordance with the control program, for example, for each weft thread 15A or for a number of weft threads 15B, 15C as will be described in more detail below with reference to FIG. 5. When the leno rotor ring 7 oscillates, it is also not necessary to rotate the leno thread supply spools 21' and 22' nor their carrier.

Figure 4:
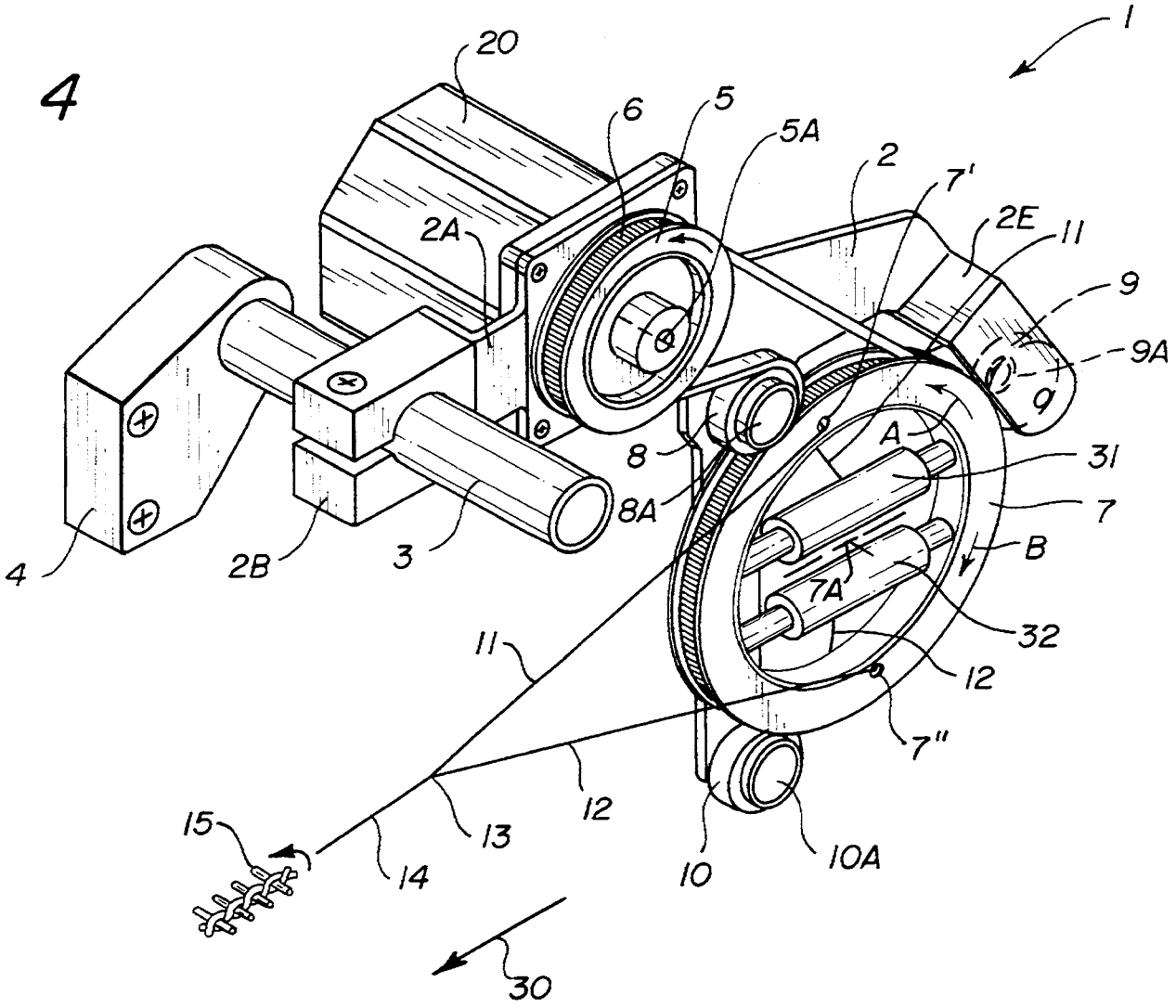
FIG. 4 is a perspective view of another embodiment in which the leno thread supply spools are mounted directly within a leno rotor ring.

FIG. 4 illustrates a modification of the present leno selvage device. In FIG. 4 the leno thread supply coils 31 and 32 are directly mounted in the leno rotor ring 7. In this embodiment the slots for the leno threads are replaced by eyelets 7' and 7" through which the leno threads 11 and 12 pass respectively. The mounting of the ends of the leno spools 31 and 32 in the ring 7 is such that a certain self-braking action is imposed so that these spools 31 and 32 are not freely rotatable, for example if a spring not shown applies the braking action to the spools or their core. However, the oscillating rotation indicated by the arrows A and B of the leno rotor ring 7 is such that a required length of leno thread 11 and 12 is pulled off the respective spool 31, 32 while keeping the threads tight by the braking action to form the front leno shed shown in FIG. 4. The thread withdrawal takes place substantially in the fabric travel direction 30.

Figure 5:
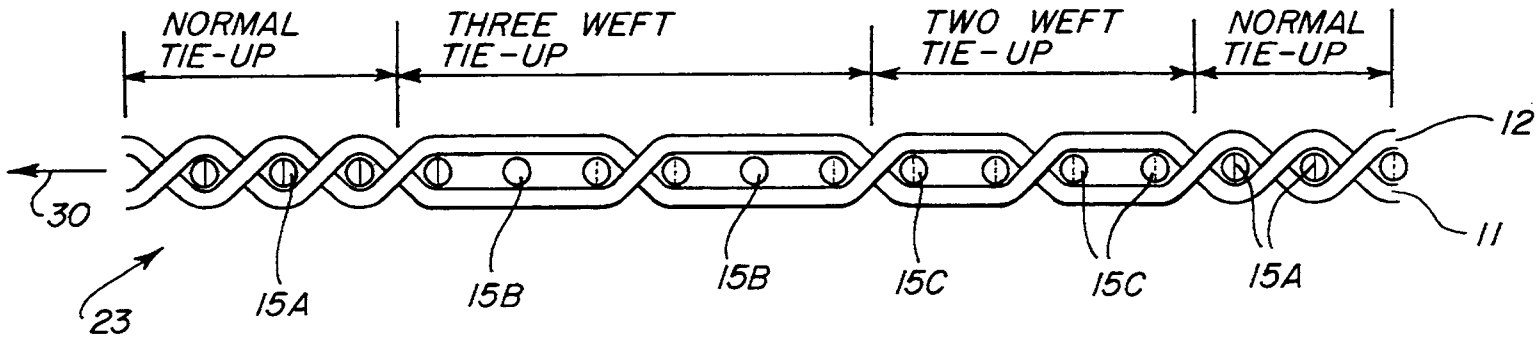
FIG. 5 illustrates a side view of a selvage formed according to the invention, wherein the weft threads extend perpendicularly to the plane of the drawing and in the view direction.

FIG. 5 shows on an enlarged scale three different types of tie-ups or bindings for the weft thread 15 along a selvage 23 of a fabric moving in the direction 30. Individual weft threads 15A are bound in a normal tie-up, whereby each individual weft thread 15A is tied. Weft threads 15B, on the other hand, are tied in groups of three in a three weft tie-up. Weft threads 15C are tied-up in groups of two to form a two weft tie-up. According to the invention, such modified tie-ups are easily accomplished, simply by controlling the oscillation or revolution of the leno rotor ring 7 through a control program that controls the operation of the reversible motor 20. The number of tie-ups can be controlled in sequence. For example, each multi tie-up can be separated from its neighboring multi tie-up by a single tie-up or any other sequence combination.

Figure 6:
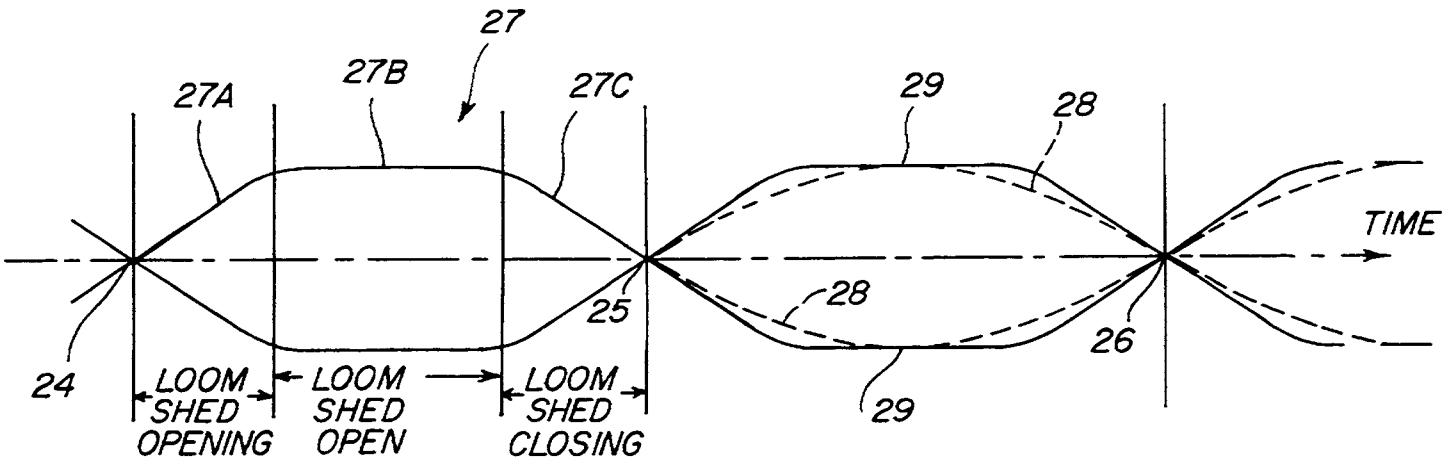
FIG. 6 shows the motion sequence of the loom shed formation superimposed on the motion sequence for forming the leno shed.

FIG. 6 illustrates the synchronism between the formation of the loom shed 27 and the leno shed 28. Beat-up takes place at points 24, 25, and 26. The shed 27 is opening over the curve portion 27A. The shed is open over the curve portion 27B. The shed closes again over the curve portion 27C. Further, the control of the motor 20 for the leno rotor ring 7 is such that the leno shed 28 has its maximum opening 29 substantially in the center of the loom shed open state. This feature assures the proper insertion of the weft ends into both leno sheds. However, it is not necessary that the tie-up of the weft ends by the leno threads takes place exactly in synchronism with the beat-up of the weft against the fabric, a certain coordination is sufficient by linking the drive program for the motor 20 with the main loom drive control. While the coincidence point 29 is desirable, it is not very critical that the center of the shed open state coincides exactly with the maximum opening of the leno shed.

Although the invention has been described with reference to specific example embodiments, it will be appreciated that it is intended to cover all modifications and equivalents within the scope of the appended claims.

What we claim is:

1. A leno selvage device for a loom, comprising a leno rotor and a reversible controllable electric motor having a power output shaft connected to said leno rotor to form a structural unit, said leno rotor comprising two leno thread guide openings positioned diametrically opposite each other.

2. The device of claim 1, wherein said structural unit further comprises a carrier arm, a plurality of guide rollers rotatably mounted on said carrier arm for rotatably holding said leno rotor, said carrier arm forming a mounting shield, said electric motor being connected to said mounting shield, a mounting member connected to said carrier arm for mounting said structural unit to said loom, said mounting member including an element for position adjusting said structural unit, and a drive power transmission between said leno rotor and said output shaft of said controllable electric motor.

3. The device of claim 2, wherein said drive power transmission comprises a pulley on said motor output shaft and a belt looping around said pulley and said leno rotor.

4. The device of claim 3, wherein said pulley and said leno rotor have outer gear teeth and wherein said belt is a gear belt.

5. The device of claim 1, wherein said leno rotor is a rotor ring, or disk, or wheel.

6. The device of claim 5, further comprising two leno thread supply spools (31,32) having ends directly mounted in or on said ring, or disk, or wheel.

7. The device of claim 6, further comprising a brake member for retarding a rotation of said leno thread supply spools.

8. The device of claim 2, wherein said plurality of guide rollers comprise three guide rollers rotatably mounted on said carrier arm at angular spacings forming a three-point steady rest for said rotatable leno rotor.

9. The device of claim 1, wherein said structural unit further comprises a mounting mechanism for mounting said structural unit in said loom, said mounting mechanism including an element for position adjusting said structural unit at least in a direction parallel to a weft insertion direction to accommodate different weaving widths.

10. The device of claim 9, wherein said mounting mechanism comprises a clamp and a stub or rod adapted to extend in parallel to said weft insertion direction, said clamp having a clamping element position adjustable on said stub or rod.

11. The device of claim 1, wherein said structural unit comprises a carrier arm on which said leno rotor and said electric motor are mounted, said carrier arm having side walls forming a housing at least for said leno rotor, said leno rotor housing being adapted to be closed by a cover.

12. The device of claim 11, further comprising a drive transmission between said power output shaft of said electric motor and said leno rotor, said drive transmission being housed in said leno rotor housing with said leno rotor.

13. The device of claim 11, further comprising a pressure source connected to said leno rotor housing for maintaining a slight excess pressure in said leno rotor housing.

14. The device of claim 11, wherein said leno rotor housing and said carrier arm are a precision cast component.

* * * * *

UNITED STATES PATENT AND TRADEMARK OFFICE

CERTIFICATE OF CORRECTION

PATENT NO. : 5,524,678

DATED : June 11, 1996

INVENTOR(S) : Horst Haeussler et al.

It is certified that error appears in the above-identified patent and that said Letters Patent is hereby corrected as shown below:

Column 5, line 34, replace "bolt" by --belt--;

Column 5, line 41, replace "7c" by --7C--;

Column 5, lines 43 and 44, replace "lane" by --leno--.

Signed and Sealed this

Third Day of September, 1996

Bruce Lehman

*Attest:*

BRUCE LEHMAN

*Attesting Officer*

*Commissioner of Patents and Trademarks*